US006862975B2

(12) United States Patent
Shintoku et al.

(10) Patent No.: US 6,862,975 B2
(45) Date of Patent: Mar. 8, 2005

(54) APPARATUS FOR LUBRICATING PISTON TYPE COMPRESSOR

(75) Inventors: Noriyuki Shintoku, Kariya (JP); Shinichi Sato, Kariya (JP); Akio Saiki, Kariya (JP); Nobutoshi Banno, Kariya (JP); Jun Kondo, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 131 days.

(21) Appl. No.: 10/326,744

(22) Filed: Dec. 20, 2002

(65) Prior Publication Data

US 2003/0141149 A1 Jul. 31, 2003

(30) Foreign Application Priority Data

Dec. 21, 2001 (JP) ..... 2001-389940
Dec. 6, 2002 (JP) ..... 2002-355589

(51) Int. Cl.[7] ..... F01B 31/10
(52) U.S. Cl. ..... 92/154; 92/156; 92/71
(58) Field of Search ..... 92/154, 156, 71; 91/499, 501

(56) References Cited

U.S. PATENT DOCUMENTS 3,888,604 A * 6/1975 Oshima et al. ..... 417/269
4,127,363 A * 11/1978 Kato et al. ..... 417/269
4,321,019 A * 3/1982 Degawa et al. ..... 417/269
5,181,834 A * 1/1993 Ikeda et al. ..... 92/71
5,183,394 A * 2/1993 Fujii et al. ..... 92/71
5,836,748 A 11/1998 Kawaguchi et al. ..... 417/222.2

FOREIGN PATENT DOCUMENTS

| | | |
|---|---|---|
| DE | 29 22 307 | 12/1979 |
| JP | 05-312145 | 11/1993 |
| JP | 06/101641 | 4/1994 |
| JP | 07/063165 | 3/1995 |
| JP | 07/317655 | 12/1995 |

* cited by examiner

*Primary Examiner*—Edward K. Look
*Assistant Examiner*—Michael Leslie
(74) *Attorney, Agent, or Firm*—Woodcock Washburn LLP

(57) ABSTRACT

A lubricating structure in a piston type compressor has a housing, a device for being lubricated and a rotary shaft. The housing defines an accommodating chamber and a suction pressure region. The device for being lubricated is located in the accommodating chamber. The rotary shaft is rotatably supported by the housing. The rotary shaft includes a supply passage, a communicating port, a lubricating hole and a flow guiding portion. The supply passage transfers fluid that contains lubricant. The communicating port interconnects the supply passage and the suction pressure region. The lubricating hole interconnects the accommodating chamber and the supply passage. The flow guiding portion is formed on a circumferential surface of the supply passage and is located near the lubricating hole. The flow guiding portion guides the lubricant toward the lubricating hole.

25 Claims, 10 Drawing Sheets

APPARATUS FOR LUBRICATING PISTON TYPE COMPRESSOR

BACKGROUND OF THE INVENTION

The present invention relates to a method and an apparatus for lubricating a piston type compressor and more particularly to a lubricating structure in a piston type compressor for guiding lubricant to a drive mechanism that reciprocates a piston.

Unexamined Japanese Patent Publication No. 6-101641 discloses a compressor of such type. The compressor is a double-headed piston type swash plate compressor. A cylindrical passage that has a spiral groove is formed in a drive shaft of the compressor. The cylindrical passage opens in a low pressure chamber or a suction pressure region at its first end and extends toward its second end. A lubricating hole is formed in a circumferential surface of the drive shaft in a radial direction of the drive shaft for guiding lubricant to thrust bearings that rotatably support a swash plate. As the drive shaft rotates, the lubricant is transferred along the spiral groove toward the second end. Subsequently, the lubricant is fed to the thrust bearings through the lubricating hole and flows into a crank chamber. Thus, the lubricant lubricates a sliding surface between the swash plate and a shoe, a sliding surface between the shoe and the piston, and a sliding surface of the thrust bearing in the drive mechanism that reciprocates the piston.

An unwanted feature is that the above disclosed lubricating structure does not sufficiently lubricates a required lubricating portion. There is a need for a lubricating structure that improves lubrication on the drive mechanism in comparison to the above disclosed lubricating structure.

SUMMARY OF THE INVENTION

In accordance with the present invention, a lubricating structure in a piston type compressor has a housing, a device for being lubricated and a rotary shaft. The housing defines an accommodating chamber and a suction pressure region. The device for being lubricated is located in the accommodating chamber. The rotary shaft is rotatably supported by the housing. The rotary shaft includes a supply passage, a communicating port, a lubricating hole and a flow guiding portion. The supply passage transfers fluid that contains lubricant. The communicating port interconnects the supply passage and the suction pressure region. The lubricating hole interconnects the accommodating chamber and the supply passage. The flow guiding portion is formed on a circumferential surface of the supply passage and is located near the lubricating hole. The flow guiding portion guides the lubricant toward the lubricating hole.

In accordance with the present invention, a method of lubricating a drive mechanism of a piston type compressor that has a housing and a rotary shaft. The housing defines a cam chamber and a suction pressure region. The drive mechanism is located in the cam chamber. The rotary shaft includes a supply passage and a lubricating hole. The supply passage communicates with the suction pressure region. The lubricating hole interconnects the supply passage and the cam chamber. The method includes introducing refrigerant with lubricant from the suction pressure region into the supply passage, turning a flow direction of the lubricant, guiding the lubricant toward the lubricating hole, and feeding the lubricant into the cam chamber through the lubricating hole by centrifugal force due to rotation of the rotary shaft.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment of the present invention will now be described in reference to FIGS. 1 and 2.

Figure 1:
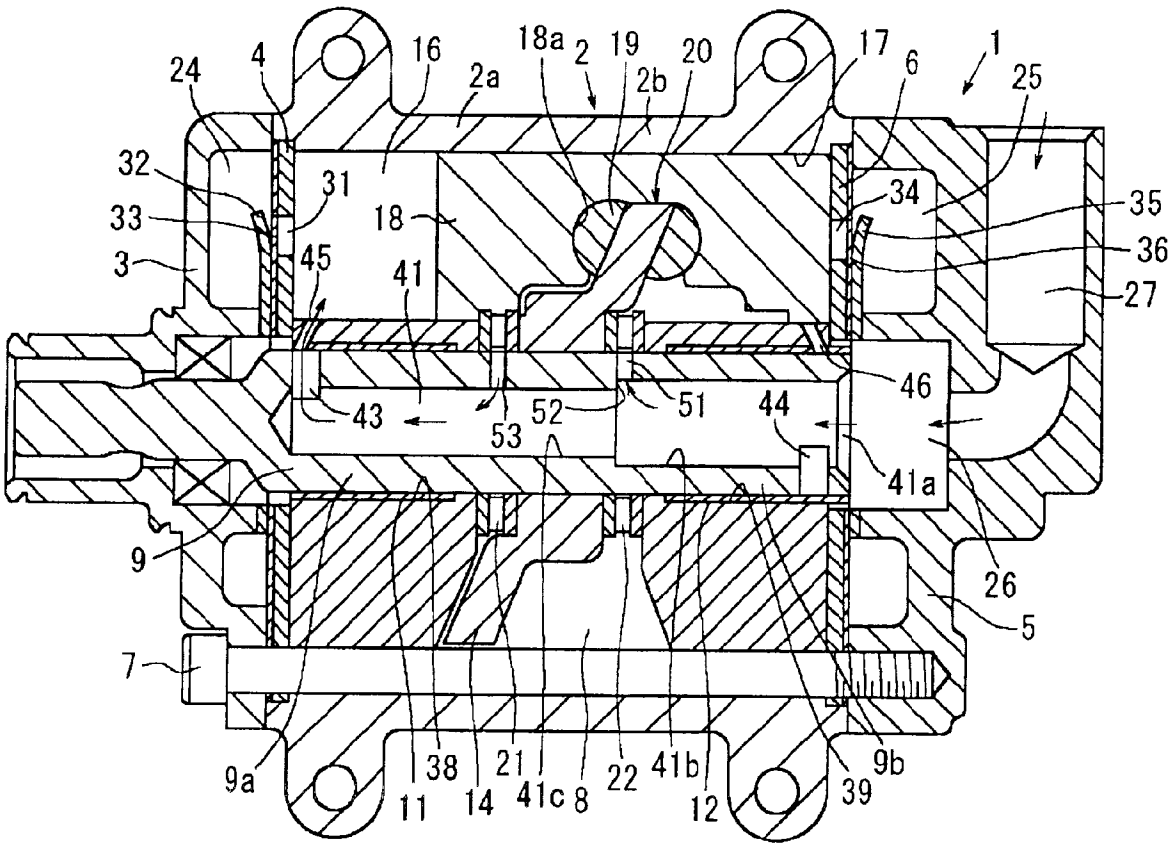
FIG. 1 is a longitudinal cross-sectional view of a double-headed piston type compressor according to a first preferred embodiment of the present invention.

Now referring to FIG. 1, a diagram illustrates a longitudinal cross-sectional view of a double-headed piston type swash plate compressor 1 according to the first preferred embodiment of the present invention. The front side and the rear side respectively correspond to the left side and the right side in the drawing. A housing of the compressor 1 includes a cylinder block 2, a front housing 3 and a rear housing 5. The front housing 3 is connected to the front end of the cylinder block 2 through a valve plate assembly 4. The rear housing 5 is connected to the rear end of the cylinder block 2 through a valve plate assembly 6. The cylinder block 2 includes a front cylinder block 2*a* and a rear cylinder block 2*b*. The above components of the housing are connected with each other by a through bolt 7.

A crank chamber, a cam chamber or an accommodating chamber 8 is defined in the cylinder block 2. A drive shaft or a rotary shaft 9 is inserted from the front side and is rotatably supported by the cylinder block 2 through a pair of journal bearings 11 and 12 on each side of the crank chamber 8. The drive shaft 9 is driven by an external drive source such as a vehicle engine, which is not shown in the drawing. A swash plate 14 is located in the crank chamber 8 and is secured to the drive shaft 9.

A plurality of front cylinder bores 16 (five cylinder bores 16 in the first preferred embodiment) is defined in the front cylinder block 2*a* and is located at equiangular positions around an axis of the drive shaft 9. The front cylinder bores 16 are parallel with each other. Similarly, a plurality of rear cylinder bores 17 is defined in the rear cylinder block 2*b* to correspond with the front cylinder bores 16. Each pair of the cylinder bores 16, 17 accommodates a double-headed piston 18 so as to slide in an axial direction of the drive shaft 9. Front and rear heads of the piston 18 are integrated by a neck portion substantially at a middle portion in the axial direction of the drive shaft 9. The neck portion extends over the peripheral end of the swash plate 14. Spherical concaves 18*a* are respectively formed on each of the front and rear heads of the piston 18 so as to face each other. A pair of substantially semi-spherical shoes 19 engages the respective spherical concaves 18*a*. The piston 18 engages the swash plate 14 through the shoes 19. The shoe 19 is interposed between the piston 18 and the swash plate 14 and slides on the piston 18 and the swash plate 14. A drive mechanism 20 includes the swash plate 14 and the shoe 19. When the drive shaft 9 rotates, its rotational motion is converted to reciprocation of the piston 18 through the swash plate 14 and the shoe 19. Reactive thrust load is generated on the drive shaft 9 in the axial direction of the drive shaft 9 due to the reciprocation of the piston 18 and is received by a pair of thrust bearings 21, 22 located on both sides of the swash plate 14.

An annular discharge chamber 24 is defined in the front housing 3 and is adjacent to the outer circumferential wall of the front housing 3. Likewise, an annular discharge chamber 25 is defined in the rear housing 5 and is adjacent to the outer circumferential wall of the rear housing 5. A suction chamber or a suction pressure region 26 is defined in the rear housing 5 and is separated from the discharge chamber 25 by a partition wall. The suction chamber 26 is substantially located at the center of the rear housing 5. The suction chamber 26 communicates with an inlet 27 that is connected to a suction conduit, which is not shown in the drawing. Suction refrigerant flows from an external refrigerant circuit into the inlet 27 through the suction conduit.

A front compression chamber is defined in the front cylinder bore 16 and expands as the piston 18 reciprocates in the front cylinder bore 16. A discharge port 31 is formed in the front valve plate assembly 4 and interconnects the front discharge chamber 24 and the front compression chamber. A discharge valve 33 is also formed in the valve plate assembly 4 and is located downstream of the discharge port 31 or at the front side of the front compression chamber. The discharge valve 33 is made of thin leaf spring, and its opening degree is regulated by a retainer 32. Similarly, a rear compression chamber is defined in the rear cylinder bore 17 and expands as the piston 18 reciprocates in the rear cylinder bore 17. A discharge port 34 is formed in the rear valve plate assembly 6 and interconnects the rear discharge chamber 25 and the rear compression chamber. A discharge valve 36 is also formed in the valve plate assembly 6 and is located downstream of the discharge port 34. The discharge valve 36 is made of thin leaf spring, and its opening degree is regulated by a retainer 35. The front and rear discharge chambers 24, 25 communicate with each other through a conduit, which is not shown in the drawing, and pressurized refrigerant from the front and rear discharge chambers 24, 25 joins and flows out to the external refrigerant circuit.

Journal bearings 11 and 12 are plain bearings and are press-fitted in respective through holes 38 and 39 that are coaxially formed at the respective center of the front and rear cylinder blocks 2*a*, 2*b*. The journal bearings 11 and 12 rotatably support respective journal portions 9*a* and 9*b* of the drive shaft 9. The drive shaft 9 partially includes a hollow space inside, and the hollow space is a supply passage 41 for transferring the suction refrigerant that contains lubricant oil. The rear end of the supply passage 41 communicates with the suction chamber 26 at a communicating port 41*a*.

An introducing port 43 is formed in the front journal portion 9*a* of the drive shaft 9 in such a manner that the introducing port 43 forms substantially a sector in shape to extend along a circumferential direction of the drive shaft 9 over a predetermined angular range, for example, over a range of an angle of 130 degrees. The introducing port 43 extends through a circumferential wall of the drive shaft 9 to communicate with the supply passage 41. Similarly, an introducing port 44 is formed in the rear journal portion 9*b* of the drive shaft 9 in such a manner that the introducing port 44 forms substantially a sector in shape to extend along a circumferential direction of the drive shaft 9 over a predetermined angular range, for example, over a range of an angle of 130 degrees. The introducing port 44 extends through a circumferential wall of the drive shaft 9 to communicate with the supply passage 41. The front introducing port 43 is shifted in phase at an angle of 180 degrees in the circumferential direction of the drive shaft 9 from the rear introducing port 44.

A suction port 45 is formed in the front journal bearing 11 and the front cylinder block 2*a* in the radial direction of the drive shaft 9. The suction port 45 communicates with the front introducing port 43 to introduce the refrigerant in the supply passage 41 into the respective front cylinder bores 16 through the introducing port 43 when the drive shaft 9 is at a predetermined angular position. Similarly, a suction port 46 is formed in the rear journal bearing 12 and the rear cylinder block 2*b* in the radial direction of the drive shaft 9. The suction port 46 communicates with the rear introducing port 44 to introduce the refrigerant in the supply passage 41 into the respective cylinder bores 17 through the introducing port 44 when the drive shaft 9 is at a predetermined angular position.

As the drive shaft 9 rotates, its rotational motion reciprocates the piston 18 in the cylinder bores 16, 17 through the swash plate 14 and the shoes 19. In the meantime, as the drive shaft 9 rotates, the front introducing port 43 of the journal portion 9*a* orbits around an axis of the drive shaft 9 so that the front introducing port 43 intermittently communicates with the respective suction ports 45 that communicates with the respective front cylinder bores 16 in a suction cycle in order. Similarly, as the drive shaft 9 rotates, the rear introducing port 44 of the journal portion 9*b* orbits around the axis of the drive shaft 9 so that the rear introducing port 44 intermittently communicates with the respective suction ports 46 that communicates with the respective rear cylinder bores 17 in a suction cycle in order. An angle of openings of the introducing ports 43, 44 is appropriately designed in such a manner that each of the cylinder bores 16, 17 keeps communicating with the respective suction ports 43, 44 during a suction cycle.

A rotary valve includes the introducing ports 43, 44 and the suction ports 45, 46 and is integrally formed with the drive shaft 9. When a cycle of the cylinder bores 16, 17 shifts from a suction cycle to a compression cycle, the corresponding suction ports 45, 46 are closed by the outer circumferential surfaces of the journal portions 9*a*, 9*b*.

As the piston 18 reciprocates in the cylinder bores 16, 17, the refrigerant in the suction chamber 26 is introduced into the cylinder bores 16, 17 from the supply passage 41 through the rotary valve. The introduced refrigerant is compressed and discharged to the discharge chambers 24, 25 through the respective discharge valves 33, 36. The front cylinder bore 16 is in a suction cycle in the drawing, and the rear cylinder bore 17 is in a discharge cycle in the drawing. The refrigerant flows along a direction indicated by arrows.

Lubrication of the drive mechanism 20 in the crank chamber 8 will now be described. Still referring to FIG. 1, a lubricating hole 51 is formed in a circumferential wall of the drive shaft 9 so as to extend in the radial direction of the drive shaft 9. The lubricating hole 51 interconnects the crank chamber 8 and the supply passage 41 for supplying the refrigerant. At least one lubricating hole 51 is provided in a circumferential direction of the drive shaft 9. One end of the lubricating hole 51 communicates with the supply passage 41, and the other end faces the rear thrust bearing 22. The lubricating hole 51 supplies lubricant oil in the supply passage 41 toward the thrust bearing 22 by centrifugal force due to rotation of the drive shaft 9. Subsequently, the lubricant oil is supplied into the crank chamber 8 through clearances in the thrust bearing 22. In the first preferred embodiment, the lubricating hole 51 faces the swash plate 14 and the shoe 19 when the piston 18 is positioned at a top dead center. As a result, portions of the swash plate 14 and the shoe 19 that receive relatively large load ensure sufficient amount of lubricant oil so that durability of the compressor 1 improves.

The lubricant oil in the refrigerant that flows into the supply passage 41 has a tendency to flow along the circumferential surface of the supply passage 41 due to its characteristic. To efficiently guide the lubricant oil toward the opening of the lubricating hole 51, the supply passage 41 on the rear side is larger in inner diameter than that on the front side. Namely, the supply passage 41 is a stepped passage. An annular step or a flow guiding portion 52 is formed in the vicinity of the opening of the lubricating hole 51.

When the cylinder bores 16, 17 are in a compression cycle, the part of refrigerant in the compression chambers leaks into the crank chamber 8 through sliding surfaces between the piston 18 and the cylinder bores 16, 17, and pressure in the crank chamber 8 possibly increases. To reduce the crank chamber pressure, at least one pressure releasing hole or a pressure releasing passage 53 is formed in the drive shaft 9 so as to extend in the radial direction of the drive shaft 9. The pressure releasing hole 53 is located near the front thrust bearing 21. One end of the pressure releasing hole 53 communicates with the supply passage 41, and the other end communicates with the crank chamber 8 through clearances in the thrust bearing 21.

Figure 2:
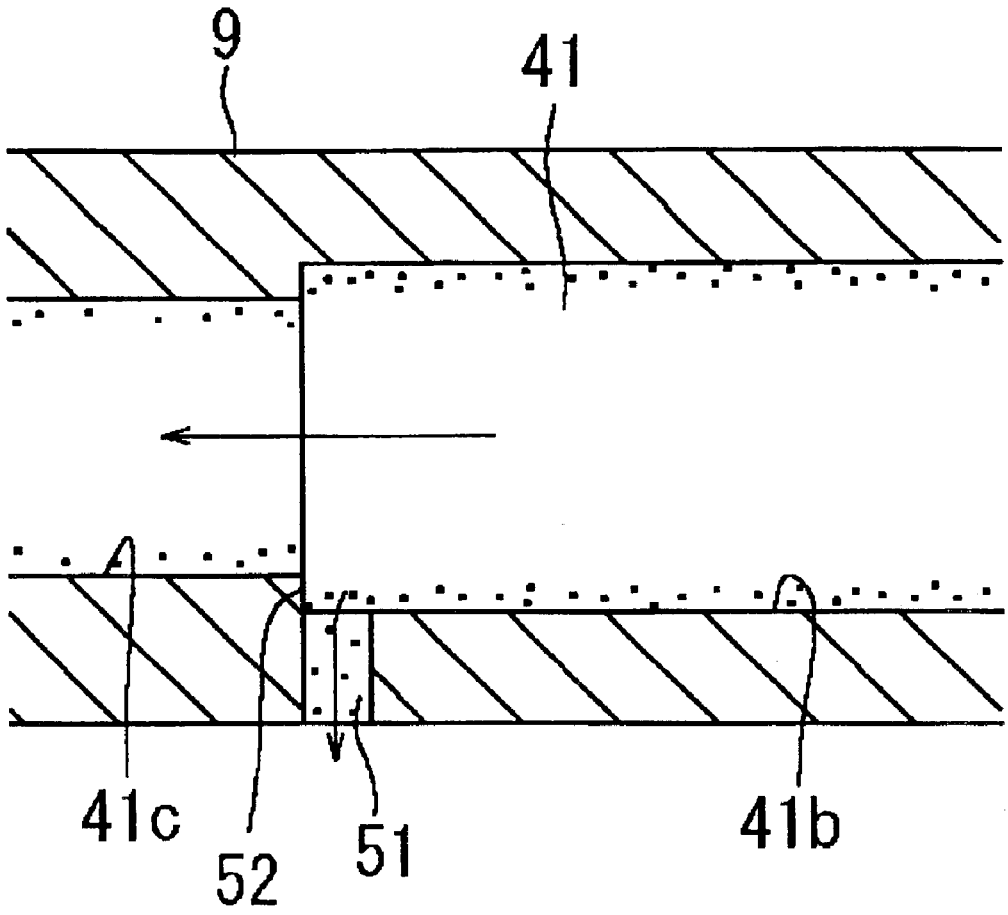
FIG. 2 is a partially enlarged longitudinal cross-sectional view of a drive shaft of the compressor according to the first preferred embodiment of the present invention.

Now referring to FIG. 2, a diagram illustrates a partially enlarged longitudinal cross-sectional view of a rotary shaft of the compressor 1 according to the first preferred embodiment of the present invention. The supply passage 41 includes a large diameter passage 41*b* and a small diameter passage 41*c*. The step 52 is formed at a boundary between the large diameter passage 41*b* and the small diameter passage 41*c* and intersects with the circumferential surface of the supply passage 41. The step 52 is located in the vicinity of the opening of the lubricating hole 51. Namely, the wall surface of the step 52 is continuous with the wall surface of the lubricating hole 51 at the same level. The step 52 dams the flow of the lubricant oil that flows along the circumferential surface of the large diameter passage 41*b* and turns a flow direction of the lubricant oil so as to guide the lubricant oil toward the opening of the lubricating hole 51.

According to the first preferred embodiment, the following advantageous effects are obtained.

In the first preferred embodiment, as the drive shaft 9 rotates, the swash plate 14 that integrally rotates with the drive shaft 9 reciprocates the double-headed piston 18 in the cylinder bores 16, 17 through the shoes 19. In accordance with the reciprocation of the piston 18, the compression chambers in the cylinder bores 16, 17 expand and reduce their volumes. The rotary valve is integrally formed with the drive shaft 9 and includes the introducing passages 43, 44 and the suction ports 45, 46. The rotary valve opens and closes as the drive shaft 9 rotates. The refrigerant flows from the external refrigerant circuit into the supply passage 41 through the suction chamber 26. The respective cylinder bores 16, 17 communicate with the supply passage 41 to initiate a suction cycle in order, so that the refrigerant in the supply passage 41 is introduced into the compression chambers of the cylinder bores 16, 17. When the piston 18 reaches a bottom dead center, the suction cycle concludes, and the piston 18 turns the other way to shift a cycle to a compression cycle. The respective cylinder bores 16, 17 are disconnected from the supply passage 41 to initiate a compression cycle in order. The refrigerant is compressed in the cylinder bores 16, 17 in a compression cycle and is respectively discharged to the discharge chambers 24, 25 through the discharge ports 31, 34 by pushing the discharge valves 33, 36. The discharged refrigerant is sent to the external refrigerant circuit.

When the compressor 1 is running, the lubricant oil flowed into the supply passage 41 with the refrigerant is supplied toward the rear thrust bearing 22 through the lubricating hole 51 by centrifugal force due to rotation of the drive shaft 9. Subsequently, the lubricant oil is fed into the crank chamber 8 through clearances in the thrust bearing 22. In this state, the lubricant oil in the supply passage 41 flows adhesively on the circumferential surface of the supply passage 41 due to its characteristic. Since the supply passage 41 includes the large diameter passage 41*b* at its upstream side, the lubricant oil flows along the circumferential surface of the large diameter passage 41*b*. Then, the step 52 dams the lubricant oil flow at the boundary between the large diameter passage 41*b* and the small diameter passage 41*c* and turns the flow direction of the lubricant oil and is guided to the opening of the lubricating hole 51. Thus, the crank chamber 8 efficiently ensures the lubricant oil.

In the first preferred embodiment, the pressure releasing hole 53 is provided at the downstream of the lubricating hole 51 for interconnecting the crank chamber 8 and the supply passage 41. Since the part of refrigerant compressed in the cylinder bores 16, 17 leaks to the crank chamber 8 through the sliding surfaces between the cylinder bores 16, 17 and the piston 18, and the crank chamber pressure increases. However, the refrigerant in the crank chamber 8 is bled to the supply passage 41 through the pressure releasing hole 53 because pressure in the supply passage 41 is lower than the crank chamber pressure. Due to the reduction of the crank chamber pressure, the lubricant oil smoothly flows from the supply passage 41 to the crank chamber 8 through the lubricating hole 51.

In the first preferred embodiment, the supply passage 41 is not only for introducing the refrigerant into the cylinder bores 16, 17 but also for feeding the lubricant oil to the crank chamber 8. Since the refrigerant with the lubricant oil actively flows in the supply passage 41, it is easy to ensure a large amount of lubricant oil. As a result, the lubricant oil is efficiently fed to the crank chamber 8.

According to the first preferred embodiment, since the lubricant oil is efficiently and actively fed to the crank chamber 8, a sufficient amount of lubricant oil is fed for lubrication. Accordingly, the sliding surfaces between the swash plate 14 and the shoe 19 and between the shoe 19 and the piston 18 in the crank chamber 8 are lubricated and are cooled. Meanwhile, the rear thrust bearing 22 is lubricated by directly feeding the lubricant oil through the lubricating hole 51, while the thrust bearing 21 is efficiently lubricated by the lubricant oil in the refrigerant that flows into the pressure releasing hole 53.

According to the first preferred embodiment, the lubricant oil in the refrigerant introduced in the supply passage 41 is separated by centrifugal force due to rotation of the drive shaft 9 and is fed through the lubricating hole 51 that extends in the radial direction of the drive shaft 9. Since the front cylinder bore 16 is located downstream of the lubricating hole 51, the lubricant oil in the refrigerant introduced into the front cylinder bore 16 is reduced. Accordingly, the lubricant oil in the refrigerant that is sent to the external refrigerant circuit is reduced, and heat exchanging performance of a heat exchanger located in the refrigerant circuit improves. The lubricant oil fed into the crank chamber 8 is reserved at the bottom of the crank chamber 8.

A second preferred embodiment of the present invention will now be described in reference to FIG. 3. The same reference numerals in the second preferred embodiment denote the corresponding components in the first preferred embodiment, and description of the substantially identical components is omitted.

Figure 3:
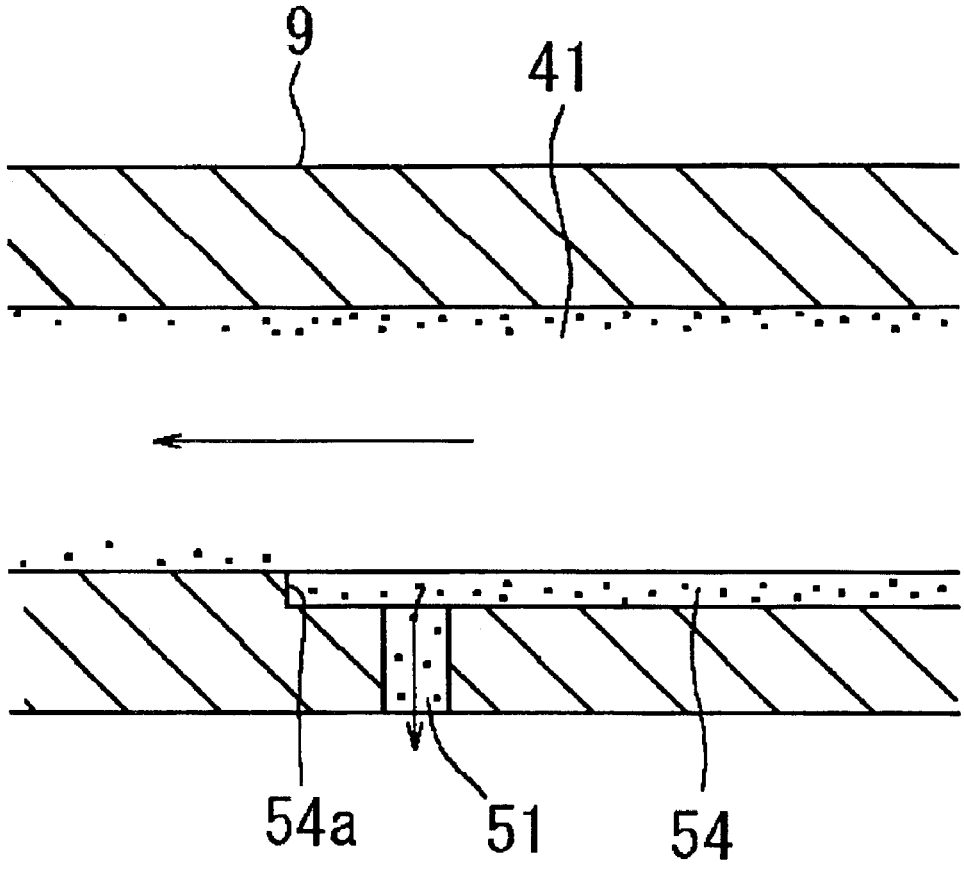
FIG. 3 is a partially enlarged longitudinal cross-sectional view of a drive shaft of a compressor according to a second preferred embodiment of the present invention.

Now referring to FIG. 3, a diagram illustrates a partially enlarged longitudinal cross-sectional view of the drive shaft 9 of the compressor 1 according to the second preferred embodiment of the present invention. A guide groove 54 is recessed on the circumferential surface of the supply passage 41 for guiding the lubricant oil and extends in the axial direction of the drive shaft 9. At least one guide groove 54 is provided in a circumferential direction of the drive shaft 9, and the lubricating hole 51 extends through the circumferential wall of the drive shaft 9 to communicate with the guide groove 54. A terminal wall surface 54*a* turns the flow direction of the lubricant oil and guides the lubricant oil to the lubricating hole 51.

According to the second preferred embodiment, the following advantageous effect is obtained.

The lubricant oil flows adhesively along the guide groove 54 and is intensively guided to the lubricating hole 51 so that the lubricant oil is efficiently fed into the crank chamber 8. Incidentally, when the guide groove 54 is formed, the opening of the lubricating hole 51 in the supply passage 41 does not need to be continuous with the terminal wall surface 54*a* of the guide groove 54 at the same level. Even if the lubricating hole 51 is located at a certain distance from the terminal wall surface 54*a*, the lubricant oil is efficiently guided to the lubricating hole 51.

A third preferred embodiment of the present invention will now be described in reference to FIG. 4. The same reference numerals in the third preferred embodiment denote the corresponding components in the first preferred embodiment, and description of the substantially identical components is omitted.

Figure 4:
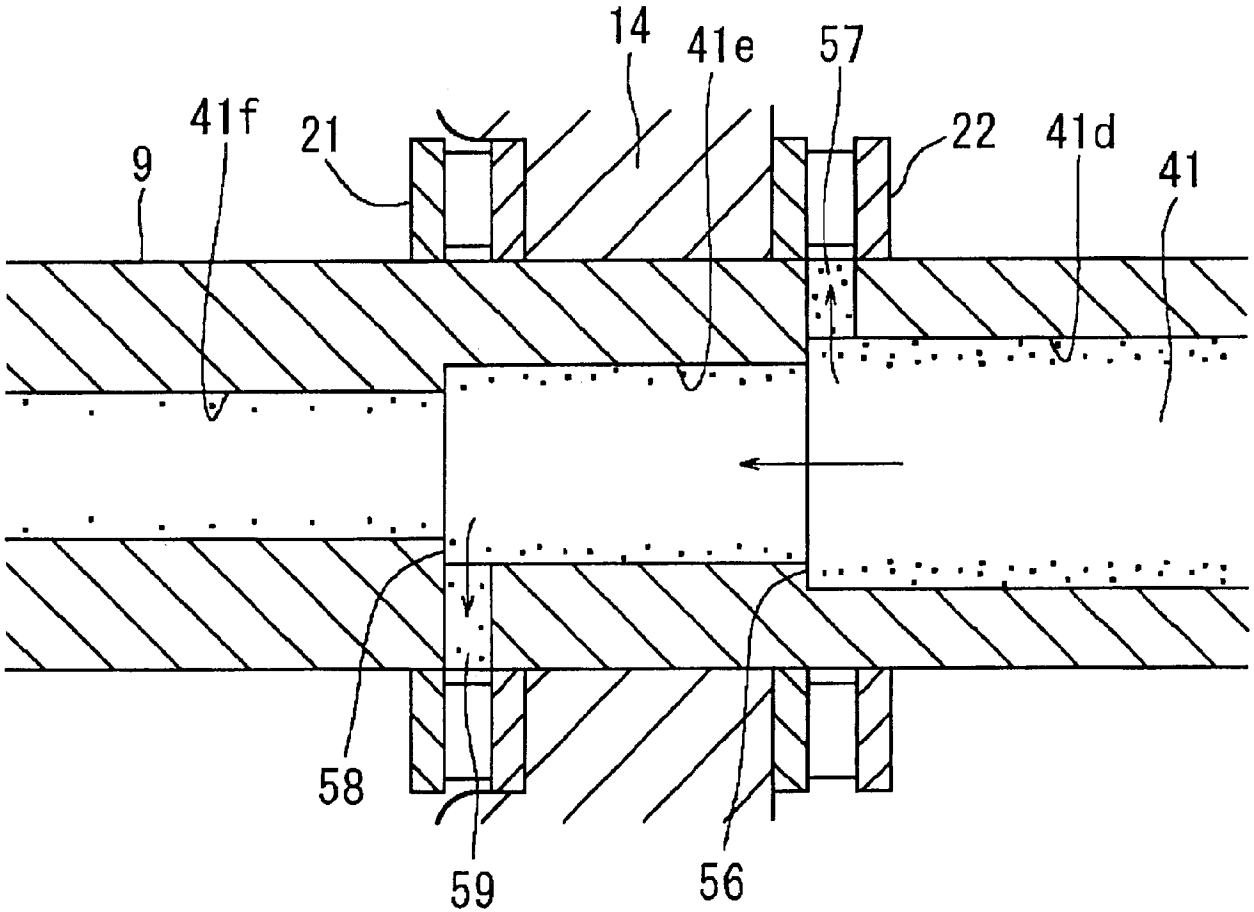
FIG. 4 is a partially enlarged longitudinal cross-sectional view of a drive shaft of a compressor according to a third preferred embodiment of the present invention.

Now referring to FIG. 4, a diagram illustrates a partially enlarged longitudinal cross-sectional view of the drive shaft 9 of the compressor 1 according to the third preferred embodiment of the present invention. The supply passage 41 includes a large diameter passage 41*d*, a medium diameter passage 41*e* and a small diameter passage 41*f*. Namely, the supply passage 41 is a double stepped passage. A step 56 between the large diameter passage 41*d* and the medium diameter passage 41*e* is located at a position corresponding with the rear thrust bearing 22, and a lubricating hole 57 is located in the vicinity of the step 56. Similarly, a step 58 between the medium diameter passage 41*e* and the small diameter passage 41*f* is located at a position corresponding with the front thrust bearing 21, and a lubricating hole 59 is located in the vicinity of the step 58.

According to the third preferred embodiment, the following advantageous effects are obtained.

In the third preferred embodiment, two pairs of the lubricating hole and the step are provided in the drive shaft 9. The lubricating holes 57, 59 guide the lubricant oil in the supply passage 41 into the crank chamber 8. The steps 56, 58 each turn the flow direction of the lubricant oil that flows along the circumferential surface of the supply passage 41 and guide the lubricant oil toward the respective lubricating holes 57, 59. Thus, the lubricant oil is efficiently fed into the crank chamber 8.

In the third preferred embodiment, the lubricating holes 57, 59 respectively face the swash plate 14 and the shoe 19 through the thrust bearings 21, 22 when the piston 18 is positioned at the top dead center. As a result, portions of the swash plate 14 and the shoe 19 that receive relatively large load ensure a sufficient amount of lubricant oil so that durability of the compressor 1 further improves.

A fourth preferred embodiment of the present invention will now be described in reference to FIG. 5. The same reference numerals in the fourth preferred embodiment denote the corresponding components in the first preferred embodiment, and description of the substantially identical components is omitted.

Figure 5:
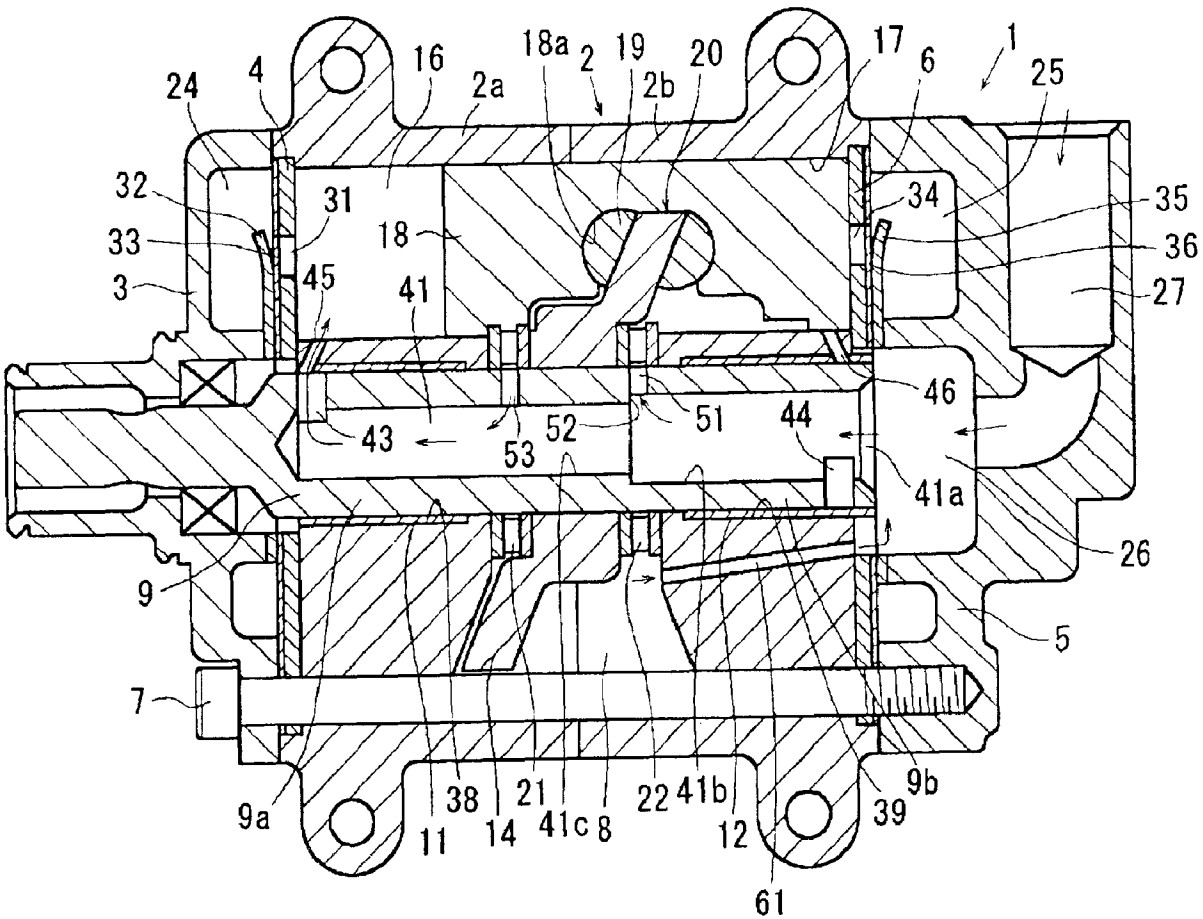
FIG. 5 is a longitudinal cross-sectional view of a double-headed piston type compressor according to a fourth preferred embodiment of the present invention.

Now referring to FIG. 5, a diagram illustrates a longitudinal cross-sectional view of a double-headed piston type compressor according to the fourth preferred embodiment of the present invention. While the compressor is continuously running in a relatively high rotational speed, the centrifugal force of the drive shaft 9 is relatively large. Due to the large centrifugal force of the drive shaft 9, the lubricant oil is further separated and is actively fed to the crank chamber 8 through the lubricating hole 51. As a result, the lubricant oil is accumulated in the crank chamber 8 more than requires, and the amount of lubricant oil in the refrigerant circulating in the refrigerant circuit becomes relatively small. This may lead to insufficient lubrication on sliding surfaces between the cylinder bores 16, 17 and the piston 18. In addition, if the lubricant oil is excessively accumulated in the crank chamber 8, the lubricant oil heats up due to shearing motion of the swash plate 14 so that a temperature in the compressor rises. Therefore, a temperature of the refrigerant supplied to the external refrigerant circuit, or a temperature of the refrigerant discharged, may rise. For the above reasons, a communication passage 61, the cross section of which is circular in shape, is formed in the rear cylinder block 2*b* and interconnects the crank chamber 8 and the suction chamber 26. The communication passage 61 partially returns the lubricant oil in the crank chamber 8 to a predetermined region in the refrigerant circuit, pressure of which is lower than that of the crank chamber 8. The communication passage 61 is, for example, formed by a drill so as to extend in a straight line. One end of the communication passage 61 communicates with the crank chamber 8, and the other end communicates with the suction chamber 26.

According to the fourth preferred embodiment, the following advantageous effect is obtained.

While the compressor is running in a relatively high rotational speed, the lubricant oil in the crank chamber 8 is returned with the refrigerant through the communication passage 61 to the suction chamber 26, which is lower in pressure than the crank chamber 8. Thus, the communication passage 61 prevents the lubricant oil from being excessively accumulated in the crank chamber 8 so that the lubricant oil is prevented from heating up due to shearing motion of the swash plate 14. As a result, a temperature of the refrigerant discharged, or a discharged refrigerant temperature, is prevented from rising. In addition, the lubricant oil returned from the crank chamber 8 is mixed with the refrigerant that is introduced in the suction chamber 26 and is introduced into the cylinder bores 16, 17 with the refrigerant. Therefore, insufficient lubrication is prevented on a sliding surface between the cylinder bores 16, 17 and the piston 18.

Incidentally, the cross-sectional area of the communication passage 61 is determined on experiment or calculation in accordance with the displacement of the compressor to prevent the discharged refrigerant temperature from rising while the compressor is running in a relatively high rotational speed. For example, the cross-sectional area of the communication passage 61 is determined based on the volume of the crank chamber 8 and pressure differential between the crank chamber 8 and the suction chamber 26.

A fifth preferred embodiment of the present invention will now be described in reference to FIGS. 6 and 7. The same reference numerals in the fifth preferred embodiment denote the corresponding components in the first preferred embodiment, and description of the substantially identical components is omitted.

Figure 6:
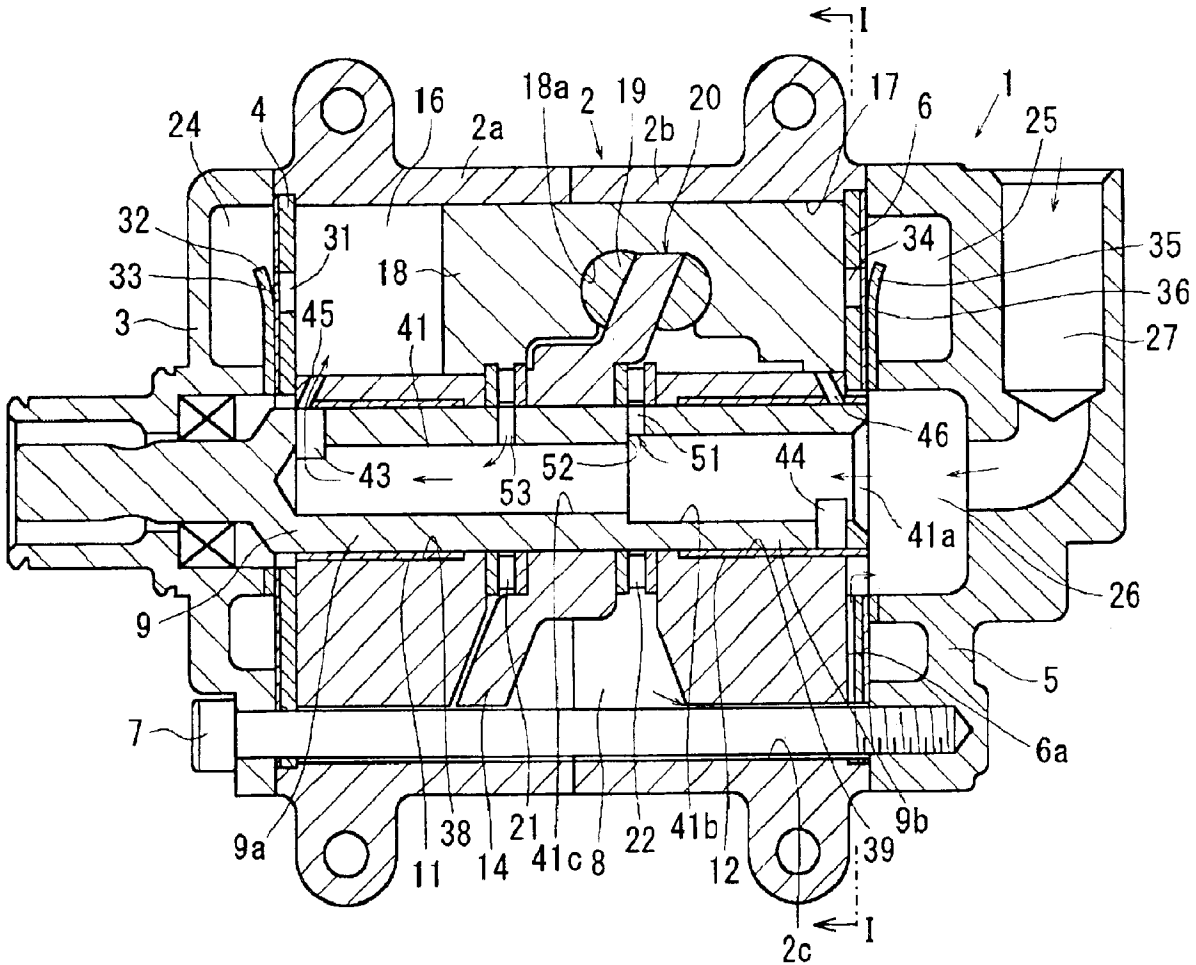
FIG. 6 is a longitudinal cross-sectional view of a double-headed piston type compressor according to a fifth preferred embodiment of the present invention.

Now referring to FIG. 6, a diagram illustrates a longitudinal cross-sectional view of a double-headed piston type compressor according to the fifth preferred embodiment of the present invention. A through hole 2*c* is formed in the rear cylinder block 2*b* for inserting the through bolt 7, and a clearance is formed between the through bolt 7 and the through hole 2*c* so that the through hole 2*c* communicates with the crank chamber 8. Meanwhile, a communication groove 6*a* is recessed in a front end surface of the rear valve port plate 6 that faces the rear cylinder block 2*a* and extends in a radial direction of the drive shaft 9. An outer end of the communication groove 6*a* communicates with the clearance, and an inner end of the communication groove 6*a* communicates with the suction chamber 26. Namely, the through hole 2*c* and the communication groove 6*a* constitute a communication passage and interconnect the crank chamber 8 and the suction chamber 26 for returning the lubricant oil in the crank chamber 8 to the suction chamber 26.

Figure 7:
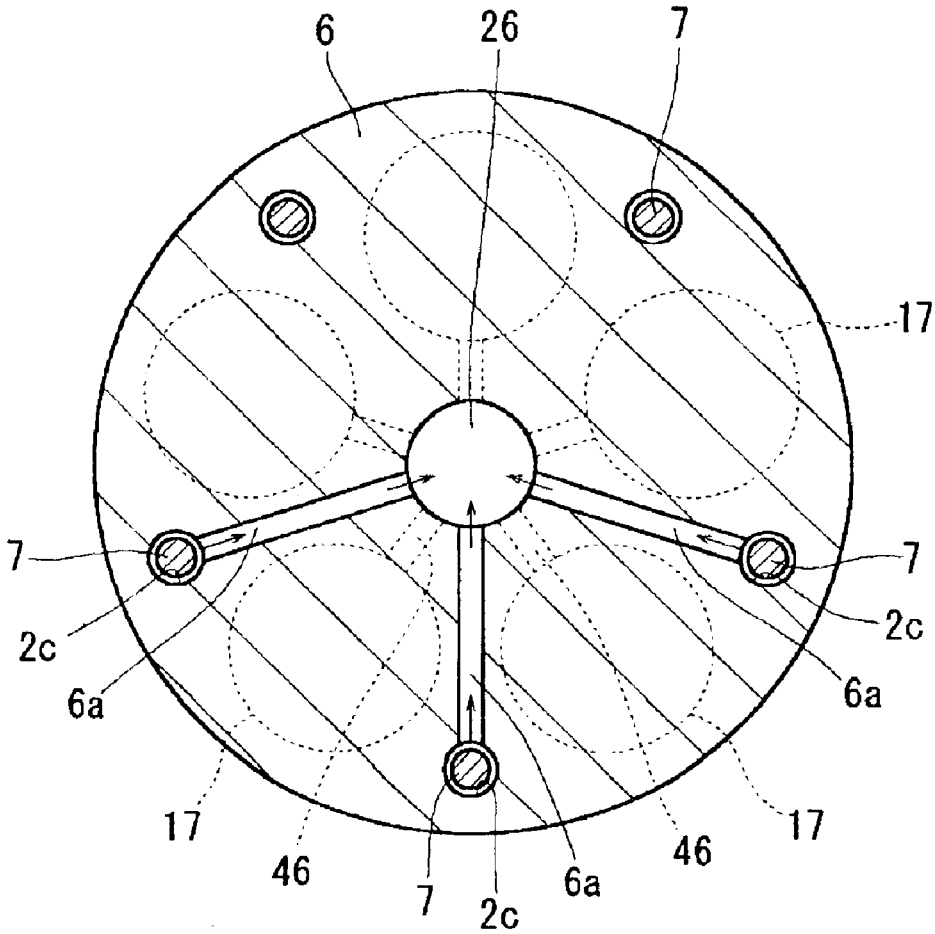
FIG. 7 is a cross-sectional end view that is taken along the line I—I in FIG. 6.

Now referring to FIG. 7, a diagram illustrates a cross-sectional end view that is taken along the line I—I in FIG. 6. A plurality of the through bolts 7, the five through bolts 7 in the drawing, are inserted into the through holes 2*c* of the cylinder block 2*b* for fastening the housing of the compressor and are aligned at a predetermined interval. The clearances are respectively formed between the through bolts 7 and the through holes 2*c* and all communicate with the crank chamber 8. The three communication grooves 6*a* are recessed to communicate with the respective through holes 2*c*, which are located at the lower side in the drawing. Namely, the three communication passages interconnect the crank chamber 8 and the suction chamber 26 of FIG. 6. In addition, the three communication passages ensure a predetermined cross-sectional area of a passage that interconnects the crank chamber 8 and the suction chamber 26 of FIG. 6.

According to the fifth preferred embodiment, the following advantageous effect is obtained.

While the compressor is running in a relatively high rotational speed, the lubricant oil in the crank chamber 8 is returned to the suction chamber 26 through the communication grooves 6*a* and the clearances between the through bolts 7 and the through holes 2*c*. Thus, the lubricant oil is prevented from being excessively accumulated in the crank chamber 8. As well as the fourth embodiment, as illustrated in FIG. 5, the discharged refrigerant temperature is prevented from rising, and insufficient lubrication is prevented on sliding surfaces between the cylinder bores 16, 17 and the piston 18.

The present invention is not limited to the embodiments described above, but may be modified into the following alternative embodiments.

Figure 8:
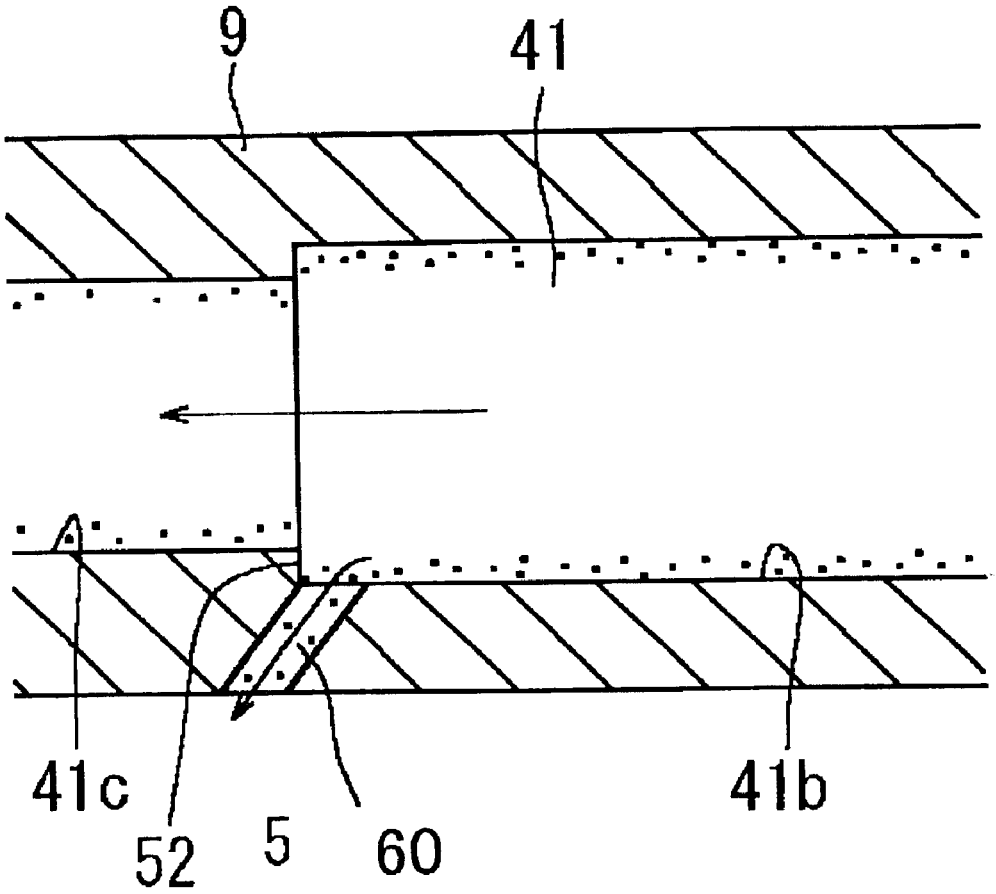
FIG. 8 is a partially enlarged longitudinal cross-sectional view of a drive shaft of a compressor according to an alternative embodiment of the present invention.

In alternative embodiments to the above preferred embodiments, referring to FIG. 8, a diagram illustrates a partially enlarged cross-sectional view of the drive shaft 9. A lubricating hole 60 is inclined relative to a hypothetical plane perpendicular to the axis of the drive shaft 9.

Figure 9:
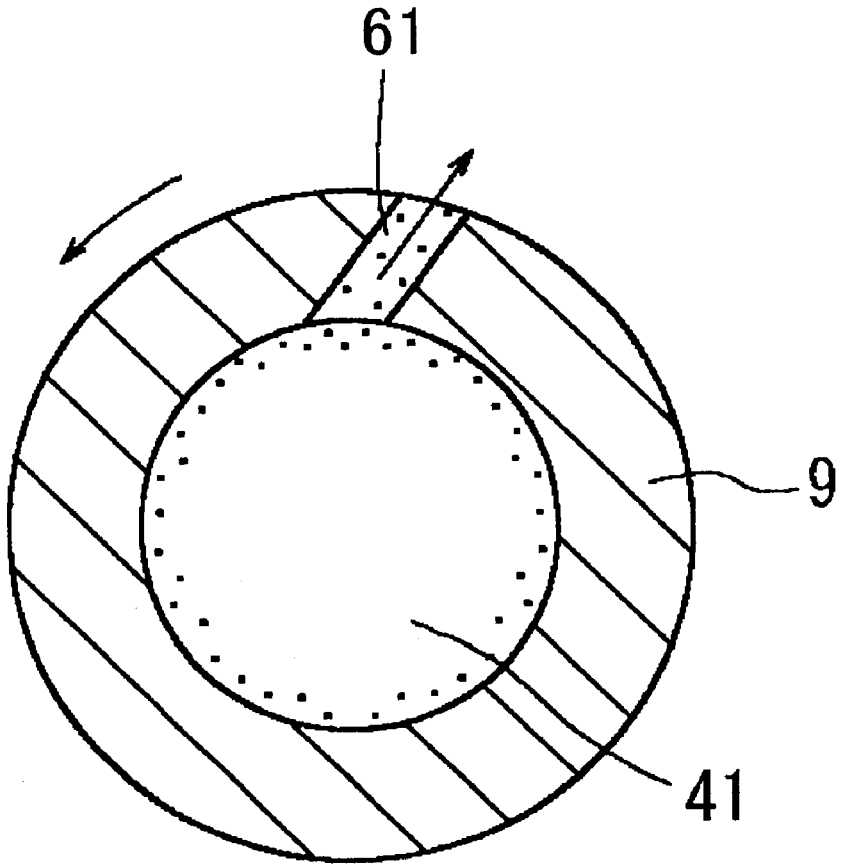
FIG. 9 is a partially enlarged cross-sectional end view of a drive shaft of a compressor according to an alternative embodiment of the present invention.

In alternative embodiments to the above preferred embodiments, referring to FIG. 9, a diagram illustrates a cross-sectional end view of the drive shaft 9. An axis of a lubricating hole 61 is inclined relative to a hypothetical plane that includes the axis of the drive shaft 9. Preferably, the lubricating hole 61 is formed to reduce flow resistance of the lubricant oil.

In alternative embodiments to the above preferred embodiments, the drive shaft 9 includes a discharge passage or a refrigerant passage for feeding the lubricant oil.

In alternative embodiments to the above preferred embodiments, a lubricating hole extends through the swash plate 14 and communicates with the crank chamber 8.

In alternative embodiments to the above preferred embodiments, a pressure releasing hole 53 communicates with a predetermined region, and pressure in the predetermined region is lower than the crank chamber pressure.

In alternative embodiments to the above preferred embodiments, a single-headed piston type swash plate compressor is employed. Additionally, the drive mechanism 20 is not limited to a swash plate type.

In alternative embodiments to the above preferred embodiments, a shaft seal device is located in a seal chamber or an accommodating chamber, and a lubricating hole is formed in a circumferential surface of the drive shaft 9 and interconnects the supply passage 41 and the seal chamber for feeding lubricant oil to the shaft seal device. In this state, a flow guiding portion is located near the lubricating hole for guiding the lubricant oil toward the lubricating hole.

In alternative embodiments to the above fifth preferred embodiment, the number of communication passages is not limited to three.

Figure 10:
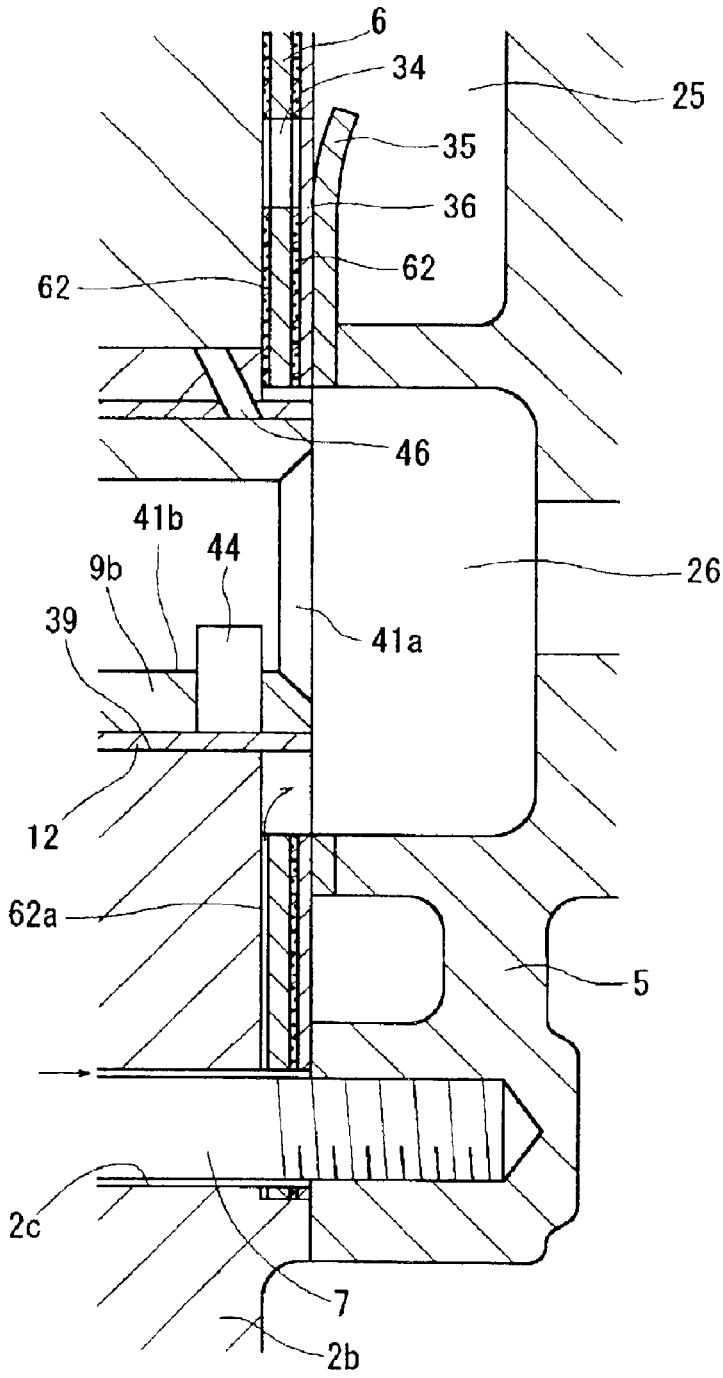
FIG. 10 is a partially enlarged longitudinal cross-sectional view of a compressor according to an alternative embodiment of the present invention.

In alternative embodiments to the above fifth preferred embodiment, referring to FIG. 10, a diagram illustrates a partially enlarged longitudinal cross-sectional view of a compressor. The compressor includes gaskets 62 that are respectively located between the valve port plate 6 and the cylinder block 2*b*, and between the valve port plate 6 and the rear housing 5. The gasket 62 adjacent to the cylinder block 2*b* includes a slit 62*a* that interconnects the through hole 2*c* and the suction chamber 26. Incidentally, the slit 62*a* is formed in the gasket 62 as shown in the drawing, while the communication groove 6*a* of FIG. 6 is formed in the valve port plate 6 to correspond with the slit 62*a*. Furthermore, a communication groove is formed in the rear end surface of the cylinder block 2*b* that faces the valve port plate 6 and interconnects the through hole 2*c* and the suction chamber 26. Incidentally, a communication passage is formed in the rear housing 5 for interconnecting the through hole 2*c* and the suction chamber 26.

Therefore, the present examples and embodiments are to be considered as illustrative and not restrictive, and the invention is not to be limited to the details given herein but may be modified within the scope of the appended claims.

What is claimed is:

1. A lubricating structure in a piston type compressor, comprising:

a housing defining a suction pressure region and an accommodating chamber;

a device for being lubricated, the device being located in the accommodating chamber; and a rotary shaft having a central axis, the rotary shaft being rotatably supported by the housing, the rotary shaft including:

a supply passage for transferring fluid that contains lubricant;

a communicating port interconnecting the supply passage and the suction pressure region;

a lubricating hole interconnecting the accommodating chamber and the supply passage; and a flow guiding portion formed on a circumferential surface of the supply passage, the flow guiding portion being located near the lubricating hole for guiding the lubricant toward the lubricating hole, wherein the device to be lubricated is a drive mechanism that is operatively connected to the rotary shaft, the accommodating chamber being a cam chamber, and wherein the rotary shaft further includes a pressure releasing passage that interconnects the cam chamber and a predetermined region, pressure in the predetermined region being lower than that of the cam chamber, the pressure releasing passage guiding the fluid in the cam chamber into the predetermined region.

2. The lubricating structure according to claim 1, wherein the pressure releasing passage interconnects the supply passage and the cam chamber.

3. The lubricating structure according to claim 1, wherein the drive mechanism includes:

a swash plate operatively connected to the rotary shaft so as to rotate integrally with the rotary shaft; and a thrust bearing located between the housing and the swash plate for rotatably supporting the swash plate, wherein the lubricating hole is located near the thrust bearing.

4. The lubricating structure according to claim 1, wherein the flow guiding portion includes a wall surface that intersects with the circumferential surface of the supply passage, the lubricating hole communicating with the supply passage near the wall surface.

5. The lubricating structure according to claim 4, wherein the rotary shaft further includes a guide groove extending along the circumferential surface of the supply passage to a terminal end of the guide groove for guiding the lubricant, the lubricating hole communicating with the guide groove near the terminal end of the guide groove.

6. The lubricating structure according to claim 1, wherein a pair of the lubricating hole and the flow guiding portion is plurally formed in the rotary shaft.

7. The lubricating structure according to claim 1, wherein the lubricating hole extends in a radial direction of the central axis of the rotary shaft.

8. The lubricating structure according to claim 1, wherein the compressor is located in a refrigerant circuit, the lubricating structure further comprising:

a passage for returning the lubricant in the cam chamber to a predetermined region in the refrigerant circuit, pressure in the predetermined region being lower than that of the cam chamber.

9. The lubricating structure according to claim 8, wherein the predetermined region is the suction pressure region.

10. A rotary shaft for lubricating a piston type compressor including a housing that defines an accommodating chamber and a suction pressure region, and a device for being lubricated, the device being located in the accommodating chamber, the rotary shaft comprising:

a supply passage formed in the rotary shaft for transferring fluid that contains lubricant;

a communicating port formed at an end of the supply passage for communicating with the suction pressure region;

a lubricating hole interconnecting the supply passage and the accommodating chamber;

a flow guiding portion formed on a circumferential surface of the supply passage, the flow guiding portion being located near the lubricating hole for guiding the lubricant toward the lubricating hole; and a rotary valve integrally formed with the rotary shaft.

11. The rotary shaft according to claim 10, further comprising:

a pressure releasing hole formed in the rotary shaft for interconnecting the supply passage and the accommodating chamber.

12. The rotary shaft according to claim 10, wherein the flow guiding portion includes a wall surface that intersects with the circumferential surface of the supply passage, the lubricating hole communicating with the supply passage near the wall surface.

13. The rotary shaft according to claim 12, further comprising:

a guide groove extending along the circumferential surface of the supply passage to a terminal end of the guide groove for guiding the lubricant, the lubricating hole communicating with the guide groove near the terminal end of the guide groove.

14. The rotary shaft according to claim 10, wherein a pair of the lubricating hole and the flow guiding portion is plurally formed in the rotary shaft.

15. A compressor comprising:

a housing defining a cylinder bore, a cam chamber and a suction pressure region;

a rotary shaft supported by the housing, the rotary shaft including:

a supply passage for transferring fluid that contains lubricant;

a communicating port interconnecting the supply passage and the suction pressure region;

a lubricating hole interconnecting the supply passage and the cam chamber;

a flow guiding portion formed on a circumferential surface of the supply passage, the flow guiding portion being located near the lubricating hole for guiding the lubricant toward the lubricating hole; and a rotary valve integrally formed with the rotary shaft;

a drive mechanism operatively connected to the rotary shaft, the drive mechanism being located in the cam chamber; and a piston located in the cylinder bore, the piston engaging the drive mechanism to reciprocate in accordance with rotation of the rotary shaft.

16. The compressor according to claim 15, wherein the supply passage includes at least a portion of suction passage for introducing the fluid into the cylinder bore.

17. The compressor according to claim 15, wherein the rotary shaft further includes a pressure releasing passage that interconnects the cam chamber and a predetermined region, pressure in the predetermined region being lower than that of the cam chamber, the pressure releasing passage guiding the fluid in the cam chamber into the predetermined region.

18. The compressor according to claim 17, wherein the pressure releasing passage interconnects the supply passage and the cam chamber.

19. The compressor according to claim 15, wherein the compressor is located in a refrigerant circuit, the compressor including a passage for returning the lubricant in the cam chamber into a predetermined region in the refrigerant circuit, pressure in the predetermined region being lower than that of the cam chamber.

20. The compressor according to claim 19, wherein the predetermined region is the suction pressure region.

21. The compressor according to claim 15, wherein the drive mechanism includes:

a swash plate operatively connected to the rotary shaft so as to rotate integrally with the rotary shaft; and a thrust bearing located between the housing and the swash plate for rotatably supporting the swash plate, wherein the lubricating hole opens near the thrust bearing.

22. The compressor according to claim 15, wherein the flow guiding portion includes a wall surface that intersects with the circumferential surface of the supply passage, the lubricating hole communicating with the supply passage near the wall surface.

23. The compressor according to claim 22, wherein the rotary shaft further includes a guide groove extending along the circumferential surface of the supply passage to a terminal end of the guide groove for guiding the lubricant, the lubricating hole communicating with the guide groove near the terminal end.

24. The compressor according to claim 15, wherein a pair of the lubricating hole and the flow guiding portion is plurally formed in the rotary shaft.

25. The compressor according to claim 15, wherein the drive mechanism includes:

a swash plate operatively connected to the rotary shaft so as to rotate integrally with the rotary shaft; and a pair of shoes located between the swash plate and the piston, wherein the lubricating hole faces the shoes and the swash plate when the piston is positioned at its top dead center.

* * * * *